US005850894A

United States Patent [19]

Busenhart

[11] Patent Number: 5,850,894

[45] Date of Patent: Dec. 22, 1998

[54] LADDER, KIT, AND POSITIONING SUPPORT FOR LADDER

[76] Inventor: Edwin Busenhart, Feldstrasse 39, CH-9621 Oberhelfenschwil, Switzerland

[21] Appl. No.: 949,823

[22] Filed: Oct. 14, 1997

Related U.S. Application Data

[63] Continuation of Ser. No. 523,898, Sep. 6, 1995, abandoned, which is a continuation of Ser. No. 185,969, May 18, 1994, abandoned.

[30] Foreign Application Priority Data

Jun. 16, 1992 [CH] Switzerland ..... 1888/92

[51] Int. Cl.[6] ..... E06C 7/48

[52] U.S. Cl. ..... 182/214; 182/107

[58] Field of Search ..... 182/214, 107, 182/229

[56] References Cited

U.S. PATENT DOCUMENTS

| | | | |
|---|---|---|---|
| 274,448 | 3/1883 | Kinzel | 182/214 |
| 471,245 | 3/1892 | McKendree | 182/214 |
| 1,096,903 | 5/1914 | Graham | 182/214 |
| 2,100,918 | 11/1937 | Ringman | 182/214 |
| 2,327,317 | 8/1943 | Randall | 182/214 |
| 2,389,349 | 11/1945 | Eastman | 248/220.1 |
| 2,592,006 | 4/1952 | Bunke | 182/214 |
| 2,797,037 | 6/1957 | Niedojaollo | 182/214 |
| 3,072,218 | 1/1963 | Peters . | |
| 3,708,080 | 1/1973 | Schlei . | |
| 3,715,012 | 2/1973 | Perry . | |
| 4,121,692 | 10/1978 | Movawski | 182/214 |
| 4,412,599 | 11/1983 | McCrudden et al. . | |
| 4,754,842 | 7/1988 | Southern . | |
| 5,012,895 | 5/1991 | Santos . | |
| 5,165,641 | 11/1992 | Southern . | |

FOREIGN PATENT DOCUMENTS

| | | | |
|---|---|---|---|
| 1.121.612 | 8/1956 | France . | |
| 1.480.212 | 5/1967 | France . | |
| 2.166.783 | 8/1973 | France . | |
| 2672933 | 8/1992 | France | 182/214 |
| 260403 | 11/1926 | United Kingdom . | |
| 409949 | 5/1934 | United Kingdom | 182/214 |
| 2090898 | 7/1982 | United Kingdom | 182/214 |
| 2 207 453 A | 2/1989 | United Kingdom . | |

*Primary Examiner*—Alvin Chin-Shue
*Attorney, Agent, or Firm*—Finnegan, Henderson, Farabow, Garrett & Dunner

[57] ABSTRACT

The novel invention relates to ladders, especially lean-on ladders. It is proposed to equip ladders with a positioning support at the production stage or as additional means such that, according to the particular use of the ladder in each case, it can be positioned and used safely and without causing damage with a lean-on or positioning element for flat walls, for example even for glass surfaces, or internal/external corners where walls meet, and even for relatively large columns. The invention makes it possible—with a level of security against accidents not possible hither—to work on a ladder without causing damage to building structures, vehicles, aircraft, ships and furniture.

9 Claims, 13 Drawing Sheets

FIG. 12a
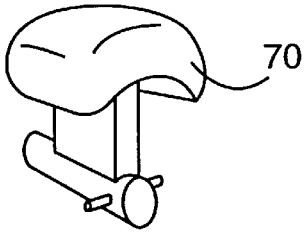
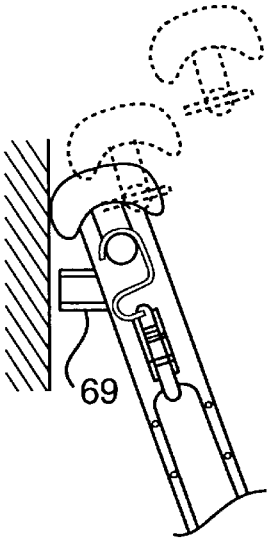
FIG. 12b
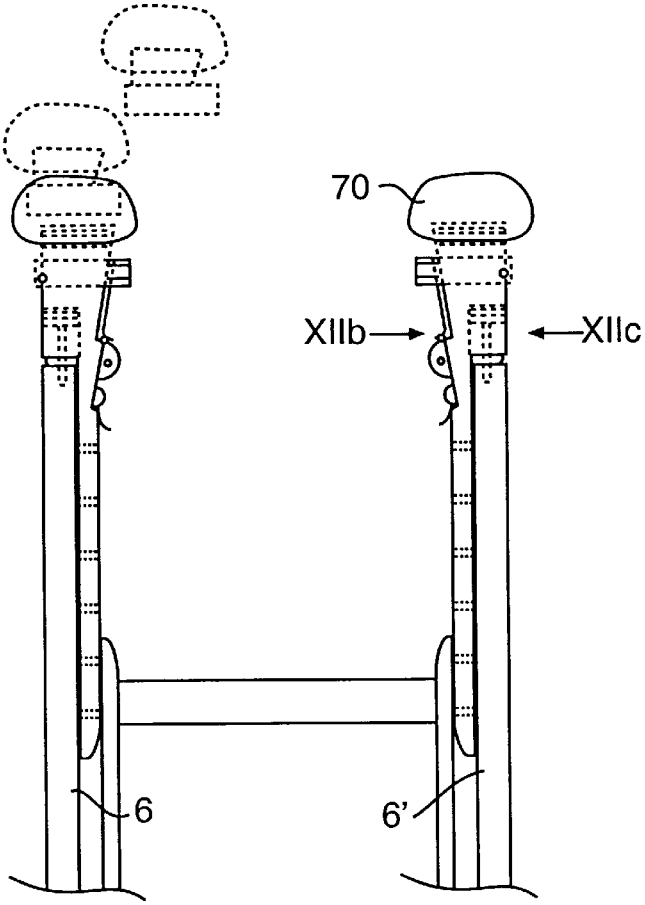
FIG. 12
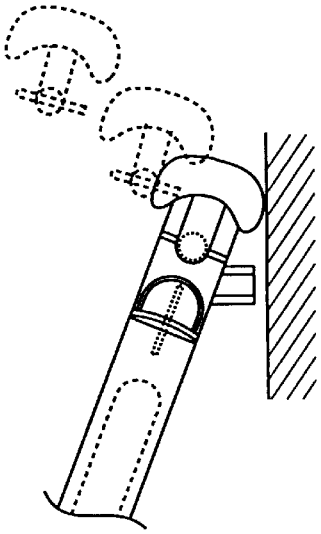
FIG. 12c

LADDER, KIT, AND POSITIONING SUPPORT FOR LADDER

This application is a continuation of application Ser. No. 08/523,898 filed Sep. 6, 1995, which was a continueation of Ser. No. 08/185,969 filed May 18, 1994, both now abandoned.

TECHNICAL FIELD

The invention relates to ladders with two stringers or stiles which are connected by rungs and which form a foot end and an opposite upper application end, and are adapted to be leaned against wall surfaces.

Ladders are probably amongst the oldest aids for workmen, and more and more for domestic and leisure use as well, for carrying out quickly small tasks at heights which the average person cannot reach.

BACKGROUND ART

Very many different kinds of ladder are produced. From for example very simple wooden ladders, aluminium ladders, stepladders, to complicated ladders for example combined extension and step ladders. Simple lean-on ladders have the advantage that positioning them at an inclination against the wall results in putting the user at a certain distance from the wall, so that, depending on the length of the ladder, articles of furniture, or some body, or for example a strip of garden in a lower corner region between ground and wall are bridged and do not cause trouble. For lean-on ladders there is an optimum angle of lean of about 70°, this corresponding to safety-technology standards and regulations.

The accident risk rises with the height to which the person using the ladder has to climb, but there are more particularly special risks with smooth ground surfaces and walls, since in such cases there is often only slight adhesion, because the contact surfaces on the ladder are very small and hard. The predominantly vertically acting forces emanating from the ladder user divide of course into a vertical force normal to the ground and a horizontal sliding force which, in the event of insufficient adhesion between ladder end and ground, on for example polished floors, can result in the ladder slipping away, which can be prevented only by a second person exerting counter-pressure on the foot end. When carrying out cleaning work on glass surfaces the risk of ladders slipping off is often obviated by using pairs of steps, or step ladders, which are independent of walls. But on the other hand a step ladder also has considerable other disadvantages, in fact, since it has only limited stability, and the working distances when carrying out work on walls are usually disadvantageous as well.

Slipping-away of a ladder at the foot end can be prevented by additional safety measures; on the other hand, sideways slipping-away of the upper application end of a ladder on the wall is a further danger. However, the general experience is that going up ladders does not present great risks provided that regulations for use are observed: for example correct angle of lean, examination of ground friction conditions, considering the nature of the wall surface, satisfactory application of the upper ladder application ends against vertical surfaces and the lower foot ends against the ground.

Thus, dangers when using ladders result not only from weight loads but more particularly from the lateral actions of forces emanating from the activity of the person on the ladder. The stiles of a ladder are usually of slightly elastic construction, so that small unevennesses, or where floor and wall do not precisely form two surfaces at right angles, are equalised-out elastically by ladder torsion. But in many cases it is not possible to eliminate relatively large deviations in that way. In actual practice, therefore, desirable ideal conditions for the positioning of ladders are unfortunately not provided, so that the user often makes risky compromises. For example he or she goes up the ladder even when only the more or less hard, point-contact application end of one stile is bearing against the wall. The other application end is then constrained by slight twisting of the ladder, though unsafely, to abut on the wall. Then especially if the user does not have a good natural technical sense, an unstable situation develops, since the action of the user's force co-operates with the internal preload of the ladder, with an only limited pressure-application adhesion. In addition, when such stresses occur the two foot ends also receive destabilising unfavourable force effects, resulting in dangerous accident situations.

Further sources of danger lie in the fact that conditions may be disadvantageous to virtually impossible for positioning ladders in certain space circumstances such as external and/or internal corners formed by walls, and this is often neglected by ladder users.

A normal ladder also cannot, without additional securing arrangements, be leaned on posts or columns of less than 40 cm diameter. Many accident-prevention authorities and ladder manufacturers issue instruction literature indicating that such risky uses are forbidden, to avoid corresponding considerable risks of accident.

Besides known accident risks, ladder users come up against a further large problem area, that of damage to wall and ground or floor surfaces by scratching, rubbing and pressure marks, for example in the case of delicate colour coatings, glass, stone, wood surfaces, etc.

SUMMARY OF THE INVENTION

The invention had as its object more particularly to improve safety for ladder users, so that accidents connected therewith can be prevented as far as possible, also to considerably widen the safe range of possible uses for lean-on ladders and also to obviate damaging buildings, without complicating the work carried out standing on ladders or complicating the use of ladders. The invention had a further part-object to make it possible for existing ladders to be provided with subsequent equipment, or refitted, in a simple and safe manner, and for use-specific various ladder application systems to be interchanged in seconds within the context of a modular system.

The solution according to the invention is characterised in that the two upper application ends have pairwise-arranged bearing contact surfaces which can be effective in or brought into two spatial directions.

The inventor perceived that hitherto the problem of ladders was so to speak seen only in one plane, or in two, as far as the manufacturer was concerned.

In normal use a lean-on ladder is placed on the ground and positioned against the wall at an angle of 70°. The ladder is dimensioned in accordance with given loads. The rest is up to the user.

For special uses it is known to provide at the application ends for example screw connections for example according to U.S. Pat. No. 4,143,743. For normal lean-on ladders the manufacturers did not take into their considerations the third plane, a transverse plane perpendicular to the wall, although it is precisely in this plane that the most problems can be eliminated, such as:

risks of accidents to users, damage to objects and articles.

To ensure safe support of the upper application ends against wall surfaces, simply bearing contact zones acting perpendicularly against the wall are not adequate. It is more particularly preferred according to the invention to arrange the bearing contact surfaces such that they contact the wall over a full surface and are constructed for example as interchangeable intensive-adhesion studs with circular bearing contact surfaces.

If additional bearing contact surfaces are arranged to act in other spatial directions it is also possible to counteract the various forces acting from the work being performed. It is proposed to arrange the individual bearing contact surfaces in paired/mirror-image situations relatively to a plane wall surface and/or to the two surfaces of an internal and/or external corner, and especially preferably the bearing contact surfaces are constructed as adhesion elements whose directions of action are situated in a common plane of action—for multifunctional usability for plane wall surfaces and for internal and external corners. It has been found, surprisingly, that according to the invention not only is great additional safety achieved in normal cases of use against plane wall surfaces but for the first time, contrary to what is prescribed in the state of the art hitherto, the use of ladders on internal and external corners is made possible, and even offers greater safety than when using ladders on a straight wall. Many tests have shown a positioning safety even in many extreme situations such as could not be achieved hitherto by means of lean-on ladders of known type.

Advantageously the common plane of action of the bearing contact surfaces is situated transversely to the two stiles, or it is adapted to be brought into a transverse plane which forms an angle of preferably about 110° relatively to the stiles. The application ends can be constructed as angled-over fixed extensions of the two stiles and the bearing contact surfaces arranged on the application ends.

The invention also relates to a ladder with two stiles which form a foot end and an upper lean-on or application end, and is characterised in that the two stiles comprise an articulation for a pivot pin in the region of the upper application ends.

In a further especially advantageous feature of the invention the application end is constructed as a positioning prop or support which is connectable via the articulations to the stiles, the articulations forming preferably an axis of rotation parallel to the rungs of the ladder. In the fitted state the positioning support is angled at about 110° relatively to the stiles, and is so limited in both directions of rotation by abutments that it can be lifted and lowered readily about the axis of rotation. Tests have shown that by means of an articulated connection the user-caused vertical spring moment of a lean-on ladder is oscillated-out, and instead of an adhesion-reducing slipping of the bearing contact surfaces an adhesion-intensive permanent pressing-on of the bearing contact surfaces is ensured. As a result, risks of accident or damage to wall surfaces are reduced or excluded. The bearing contact surfaces are constructed from individual, preferably interchangeable, rubber or plastics-type adhesion elements, for example as rubber studs. The bearing contact surfaces can be constructed as round or multi-face shaped elements, the bearing contact surfaces consisting of individual surface elements directed in various spatial directions.

According to a further feature it is proposed to construct the application ends as continuations of the two stiles, which are adjustable by means of hinge-type articulations into a position angled relatively to the stiles, and preferably the two application ends are positioning supports forming a rotatable unit.

The invention further relates to a kit for a ladder having two stiles constituting a foot end and an upper application end, and is characterised in that the kit comprises at least two transition pieces which in the region of the application end are connectable to the two stiles, and preferably have articulations.

Often, new inventions bring actual progress in the sense that, with an insignificant outlay, considerable damage, accident risks, trouble etc. could be avoided and/or rational and economic aspects are massively improved. But since an invention is connected fundamentally with products, all previous old products not having the new inventive quality should be replaced or discarded. But, on rational grounds, in actual practice this is only done to a small extent, which hinders real technical progress. In the case of ladders this problem could be solved in a surprisingly simple way with the idea according to the invention of the kit with the central element comprising two transition pieces which are fixable to the stiles, assemblable with force-locking connections with lean-on ladders by means of a pin and hole pattern system even over ranges of many different rung spacings and rung dimensions. Each transition piece can be of two-part construction; an articulation head part securely attachable on or to the stile end, and a second clamping part adapted to be connected to said articulation head part and adapted to be clamped fast along the stiles preferably with respect to a rung. 80 to 90% of all existing ladders, or lean-on ladders, can be refitted in this way. Thus existing ladders retain their material value entirely, and can be refitted with the new ladder addition system according to the invention by means of small holes at the two stile ends.

For the basic application function the kit has paired protective caps made preferably of rubber-type or synthetic plastic material type material, these being connectable at the articulations by means of rapid-action fastenings to the transition pieces and thus the lean-on ladder.

As a further main element it comprises a positioning support for a multifunctionally extended ladder use range, this being connectable via the articulations to the transition pieces and being constructed as a positioning element against internal wall corners and external wall corners and also as an application element for normal walls.

A securing element, preferably a rapid clamping element, for rapid assembly or disassembly and/or interchanging of various positioning supports or protective caps.

The interchangeable modular-type multifunctional positioning supports usually have preferably for both stiles pivot pins with surplus length for assembly with ladders of differing widths.

In an especially advantageous feature of the invention in the form of a positioning support this is characterised in that it has a plurality of elastic bearing contact surfaces which are arranged on two supporting arms pairwise in each case. Preferably there are arranged on each supporting arm at least three elastic bearing contact surfaces whose directions of action form an angle, preferably of twice 45° in each case, constructed as a 3-function head.

It has been found that a lean-on ladder with a positioning support not only provides greater safety for the user but affords also the quite special advantage of greater/optimum spacing between ladder and wall in the uppermost region even with the greater safety achieved.

It is also proposed that the positioning support has a pivot pin or two pivot pins arranged on the opposite side from the bearing contact surfaces, and preferably situated in a common plane with the bearing contact surfaces.

Advantageously the bearing contact surfaces are constructed with variously orientated bearing contact surfaces, or as individual studs with an annular bearing contact surface.

In a further advantageous feature the positioning support, secured movably on a central pivot pin, has four pivotably secured supporting arms. The four supporting arms can be brought each by means of 90° locating arrangements integral with the pivot pin into three different positions and used fivefold-functionally through 45°-angled bearing studs. The preferably soft individual bearing contact studs are made of rubber and/or soft synthetic plastic material, so that together with up to 8-fold positioning surfaces only optimum-reduced and careful pressure application forces result against highly vulnerable backgrounds such as for example glass. Especially preferably the supporting arms are arranged to be individually pivotable for a multifunctional use capability on plane surfaces and/or internal and external wall corners.

In the following the invention will now be described with the use of a plurality of examples of embodiment with further details.

BRIEF DESCRIPTION OF THE DRAWINGS

In the drawings:

FIGS. 12, 12*a*, 12*b* and 12*c* show various positions of protective caps;

DESCRIPTION OF THE PREFERRED EMBODIMENTS

Figure 1:
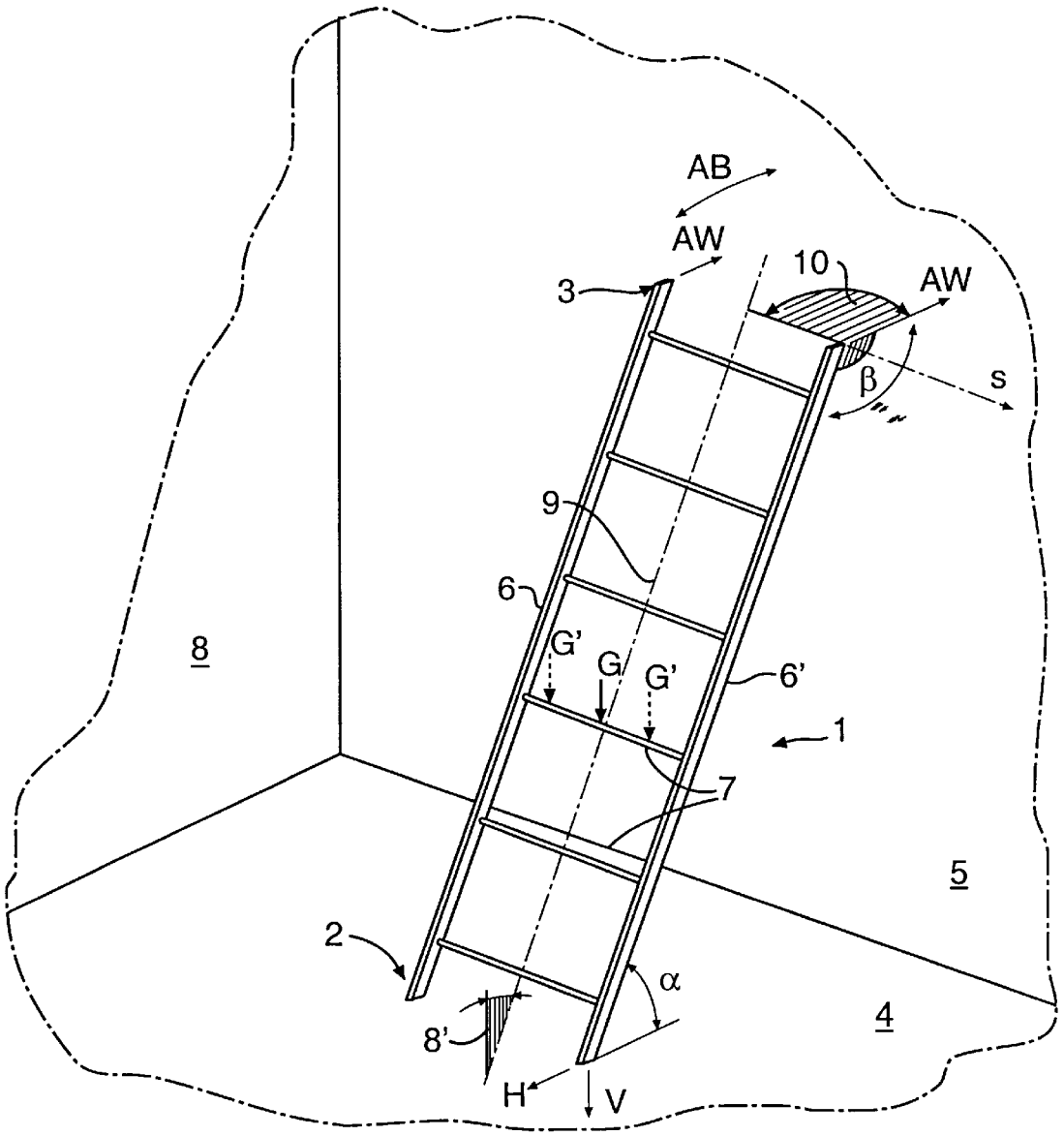
FIG. 1 shows a classic simple lean-on ladder.

FIG. 1 shows a conventional simple lean-on ladder 1 which is supported on a floor 4 by means of a foot end 2 and is leaned against a flat wall 5 by means of an upper application end 3. The lean-on ladder 1 has two stiles 6 and 6' respectively and a plurality of rungs 7. The stiles 6 and 6' of the lean-on ladder 1 are leaned at an inclination against the wall 5 at an angle $\alpha$ of about 70° to the floor 4. Considered ideally a weight G corresponding to the weight of a user divides into a vertical force V and a horizontal force H on the floor, and an application force AW against the wall 5. The lean-on ladder 1 is first placed vertically on the floor 4 and then leaned against the wall 5 parallel to the wall 8 through a vertical plane 8' through an imaginary central line 9. The two application ends 3 of the stiles 6 and 6' bring about the application force AW, these forces acting in substantially the same directions in a horizontal imaginary transverse plane 10. The corresponding angle $\beta$ supplements the angle $\alpha$ being about 110° relatively to the two stiles 6 and 6'. When being positioned against and taken away from the wall 5 the lean-on ladder 1 basically carries out a movement according to arrow AB. It is assumed that at least during use the lean-on ladder 1, or the upper application end 3, carries out no lateral movement S within the transverse plane 10.

Figure 2:
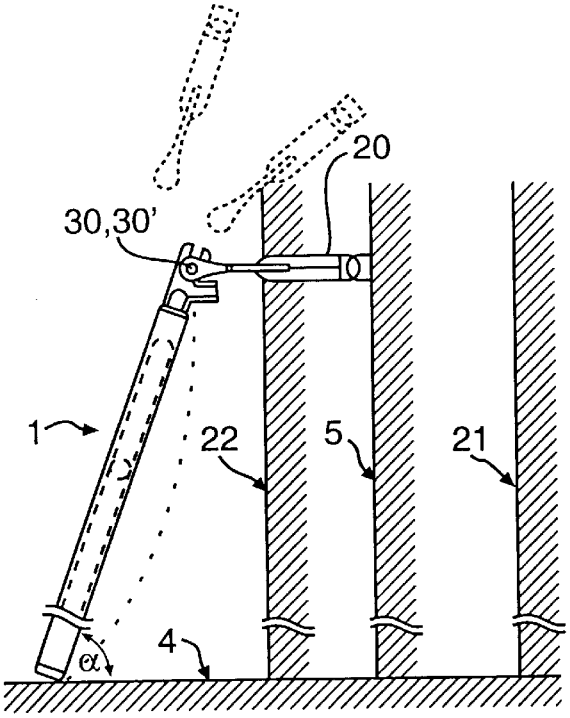
FIG. 2 is a side view of a refitted ladder according to the invention.
Figure 2A:
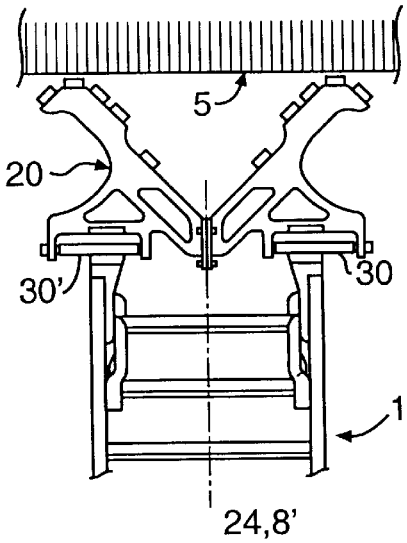
FIG. 2*a* is a plan view thereof positioned against a straight wall.
Figure 2B:
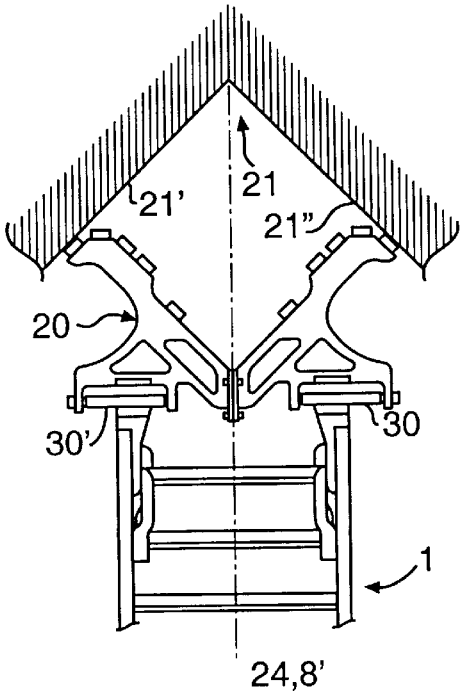
FIG. 2*b* is a plan view when the ladder is positioned against an internal corner.
Figure 2C:
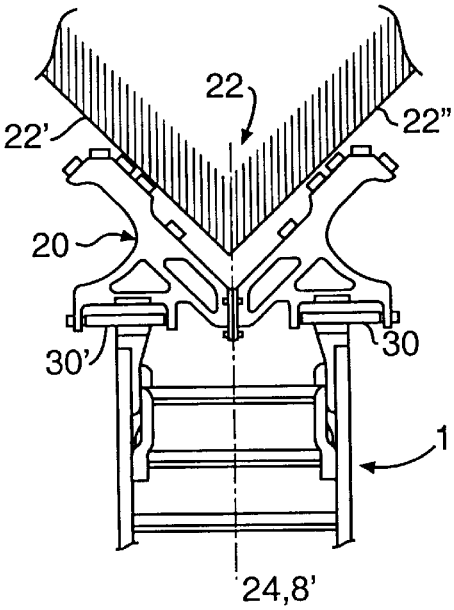
FIG. 2*c* is a plan view when the ladder is positioned against an external corner.

FIG. 2 should now be referred to, this showing an example of embodiment of the new invention, with the three most important varieties of use. FIG. 2 is a side view of a ladder 1 against a wall 5. The ladder 1 is leaned against the wall 5 via a positioning prop or support 20. FIG. 2*a* is a plan view of FIG. 2 and shows the ladder 1 used at a flat vertical wall surface 5. FIG. 2*b* is also a plan view on to FIG. 2 but shows the use of the ladder 1 on an internal corner 21 formed by two corresponding wall surfaces 21' and 21" respectively situated at an angle of 90° to one another. FIG. 2*c* is a further plan view on to FIG. 2, showing the ladder 1 used at an external corner 22 which is again formed by two corresponding wall surfaces 22' and 22" situated at an angle of 90° relative to one another.

Figure 3:
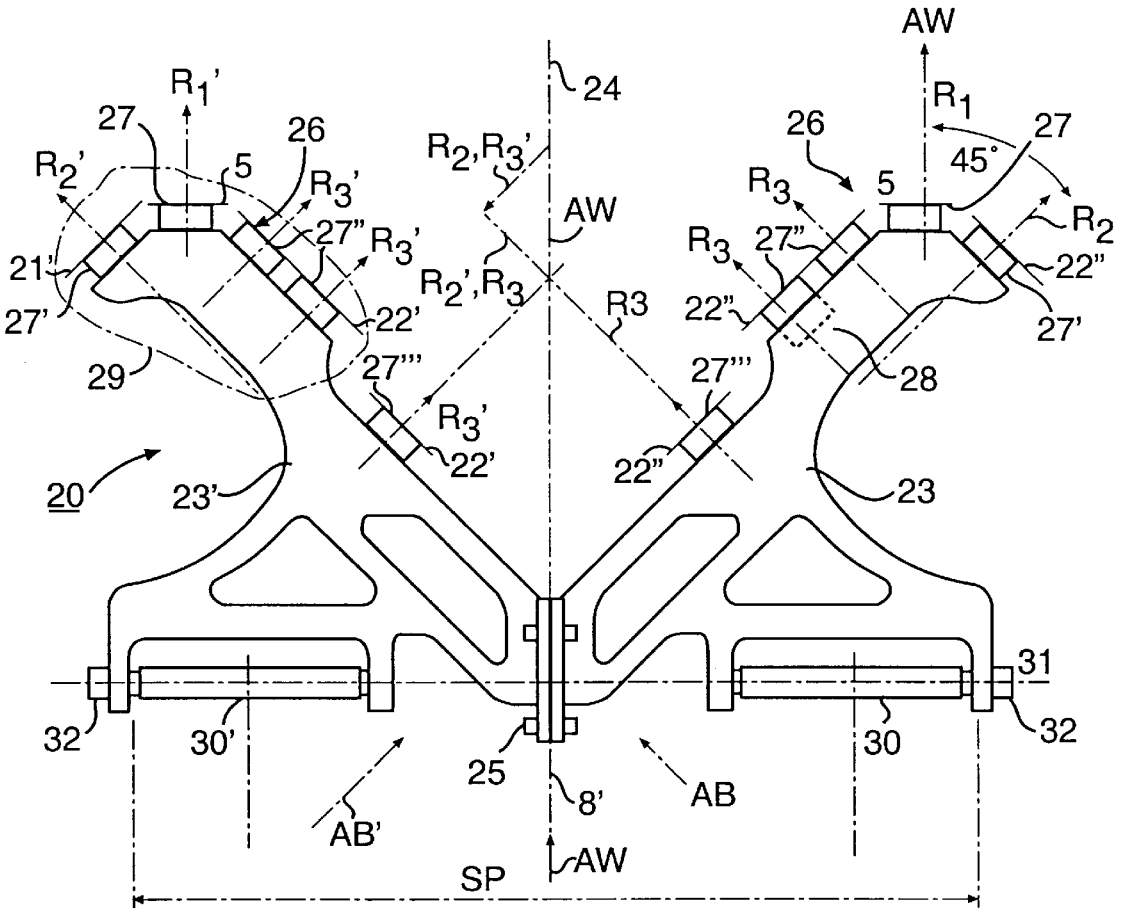
FIG. 3 shows a flat positioning support.
Figure 3A:
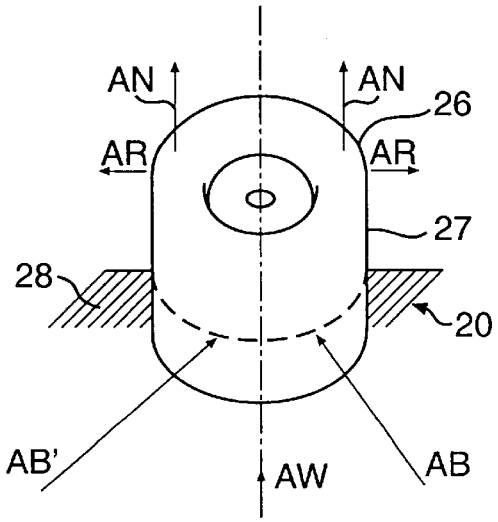
FIG. 3*a* shows a rubber stud with an annular bearing contact surface.

The positioning support 20 is shown on a larger scale in FIG. 3 and comprises two supporting arms 23, 23' respectively which are formed in mirror-image relationship with respect to a plane of symmetry 24 and are connected securely by means of screws 25 to form one unit. Arranged at the two supporting arms 23, 23' respectively are a plurality of bearing contact surfaces 26, which are formed by individual rubber studs 27. The rubber stud 27 has a direction of action R1 parallel to the vertical plane 8', and brings about substantially a perpendicular positioning force AW and is intended for positioning against a flat wall 5. An example of a rubber stud 27 is shown in perspective in FIG. 3*a* and on a larger scale again. The positioning force AW is transmitted to the wall 5 via an annular bearing contact surface 26. Here, normal forces AN and friction forces AR resulting from the lateral force actions AB, AB' respectively from the user are brought about, in accordance with the static friction between the material of the rubber stud 27 and the nature of the wall 5. Thus the stud 27 takes over very considerable lateral forces which emanate from the actions of force AB, AB' respectively. The rubber stud 27 is pressed preferably interchangeably into suitable holes 28 in the positioning support 20. The rubber stud 27' is directed to deviate at an angle of 45° from the direction of action of the positioning force AW, and is intended as a bearing contact surface 26 for an internal corner 21. Here the positioning force AW divides into a direction of action R2 and a direction of action R2' offset by 90°, over the two supporting arms 23, 23' respectively. It will also be discerned from FIG. 3 that depending on the action of force AB, or AB' respectively by the rules of statics a greater normal force is exerted either on the left-hand rubber stud 27' or on the right-hand rubber stud 27'. As a result, in accordance with the increase in the normal force on the rubber stud 27' the friction force increases, and thus the static friction is increased through the corresponding surface 26. Thus within a normal working action an increase in the lateral sliding force when using the ladder in a corner results in increasing the safety level of the ladder supporting forces. Analogously the force actions AB in the case of the rubber studs 27" result in an increase in the ladder supporting forces likewise when using the ladder at an external corner. To increase safety the studs 27" can be arranged double in each case. The rubber studs 27"' come to be used when the ladder 1 is positioned against an upright or post. The effect in this case is identical to the action of the rubber studs 27". In FIG. 3 an irregular line indicates a supporting paw 29 of the supporting arm 23'. At that side of the positioning supports 20 which is opposite from the rubber studs 27 there are arranged two pivot shafts 30, 30' respectively with a common axis of rotation 31, these being mounted rotatably by means of supporting bolts 32.

FIGS. 4, 4*a*, 4*b* and 4*c* will now be referred to, these showing analogously to FIGS. 2 to 2*c* the use of a ladder 1 on a flat wall 5 and on an internal corner 21 and external corner 22 respectively. Here the supporting paws 29 are identical to the construction shown in FIG. 3. But in FIGS. 4, 4*a*, 4*b*, 4*c* the two supporting paws 29 constitute a prolongation of the stiles 6, 6' respectively, the application end 3 being angled-over at an angle β of about 110°. The transition arc 40 can be part of the stile profile itself. This solution is especially suitable for rather short, one-piece, very economically priced ladders.

Figure 4:
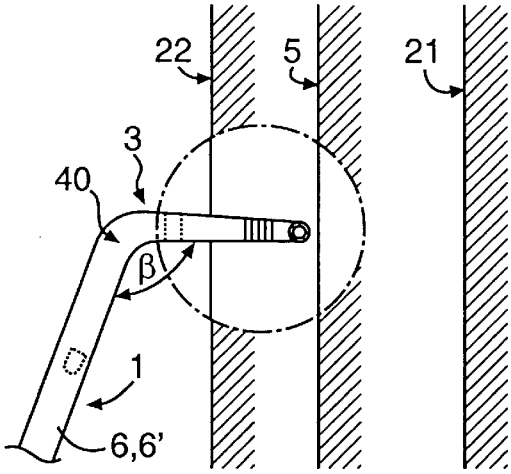
FIGS. 4, 4*a*, 4*b*, 4*c* show similarly to FIG. 2 a simple positioning support with fixed angled upper stile ends in the three basic forms of use.
Figure 4A:
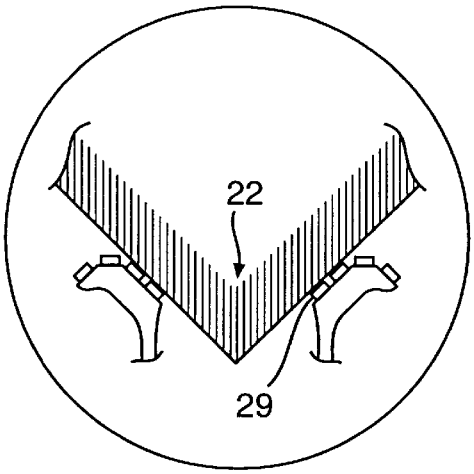
Figure 4B:
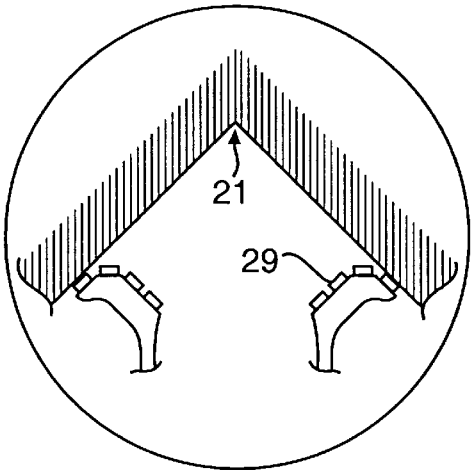
Figure 4C:
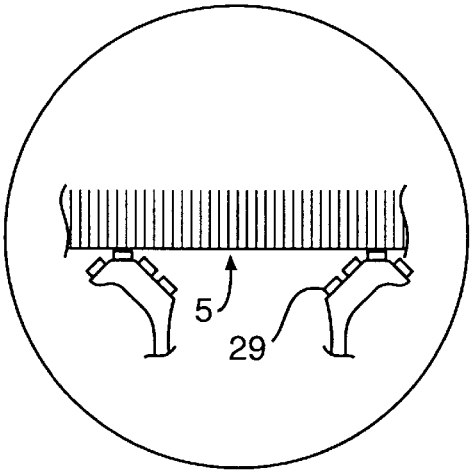
Figure 5:
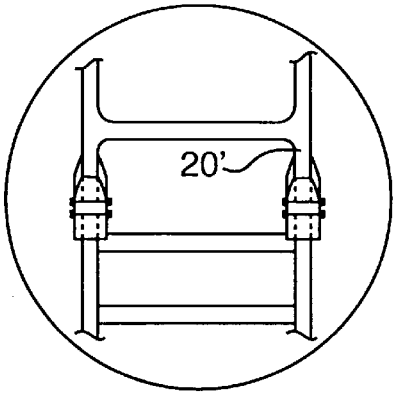
FIGS. 5 and 5*a* show angled supporting arms which are connectable securely to the stiles.
Figure 5A:
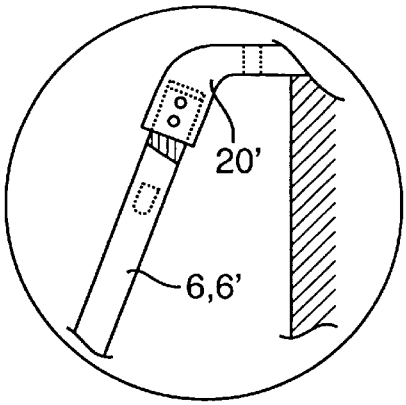

FIGS. 5 and 5*a* show a variant of FIG. 4, with a positioning element 20' connected securely to the stiles for example by screwed connections.

Figure 6:
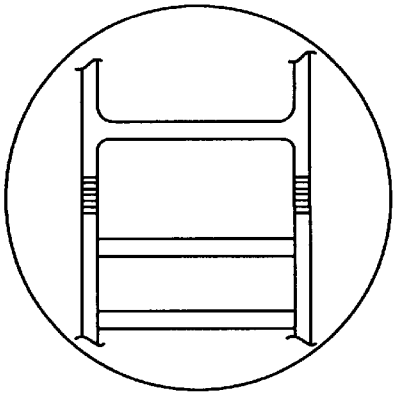
FIGS. 6 and 6*a* correspond to FIGS. 4, 4*a*, 4*b;*
Figure 6A:
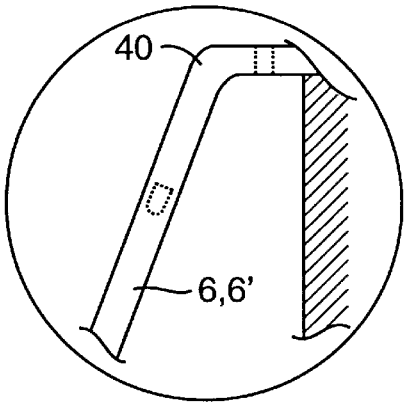

FIGS. 6 and 6*a* correspond to FIG. 4.

Figure 7:
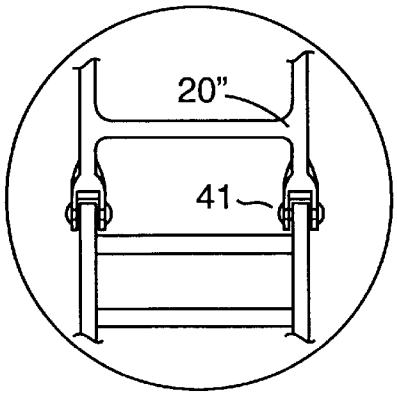
FIGS. 7 and 7*a* show angled supporting arms which are connected to the stiles by means of a hinge.
Figure 7A:
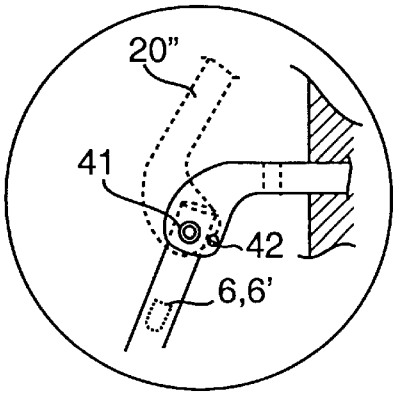

FIGS. 7 and 7*a* have a hinge 41 which establishes the connection of the positioning element 20" to the stiles 6, 6'. The hinge 41 can be put into an extended position (dashed line) when the ladder is not in use, so that only a small amount of space is required for storage. In the angled-over position (full-line position) a stop or abutment 42 secures in the working position.

Figure 8:
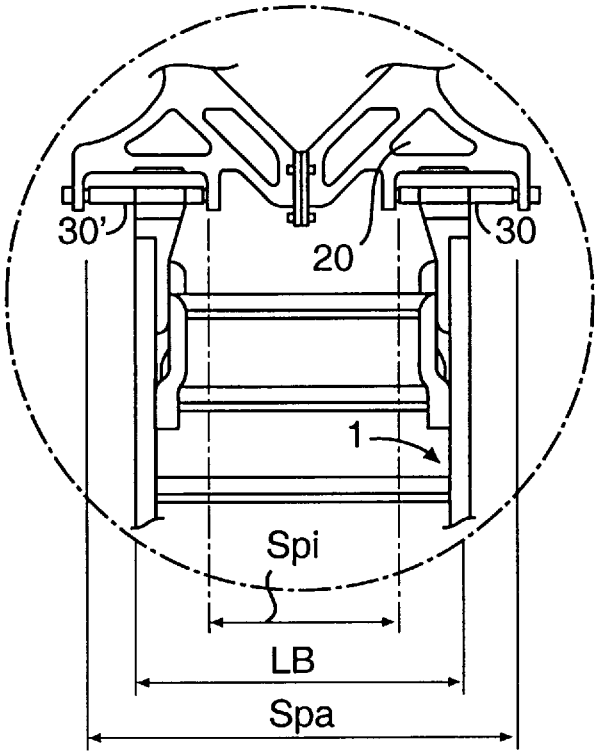
FIGS. 8 and 8*a* show angled supporting arms which are connected to the transition pieces/stiles by means of a pivot pin.
Figure 8A:
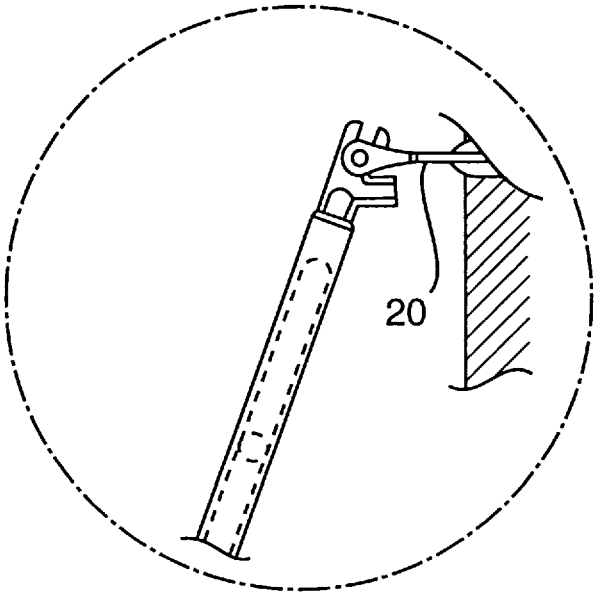
Figure 9:
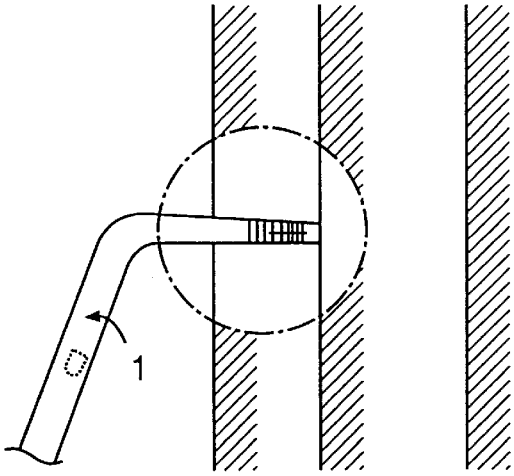
FIGS. 9, 9*a*, 9*b*, 9*c* and 9*d* show the use of pairwise-arranged one-piece supporting paws with variously orientated bearing contact surfaces in the three basic kinds of use.
Figure 9A:
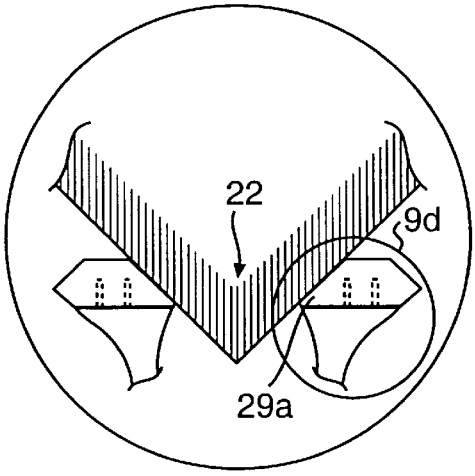
Figure 9B:
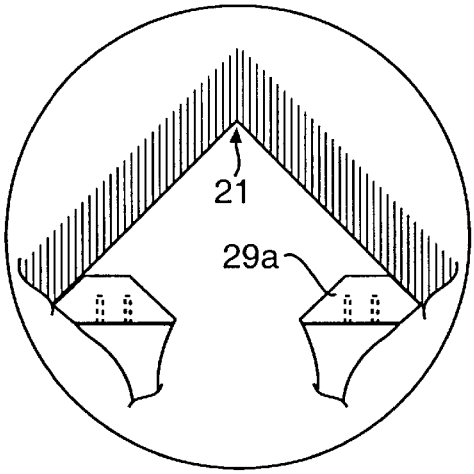
Figure 9C:
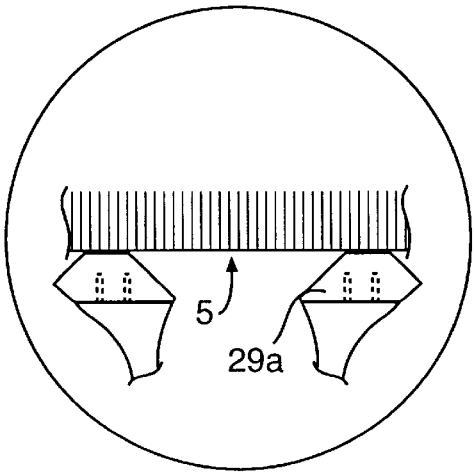
Figure 9D:
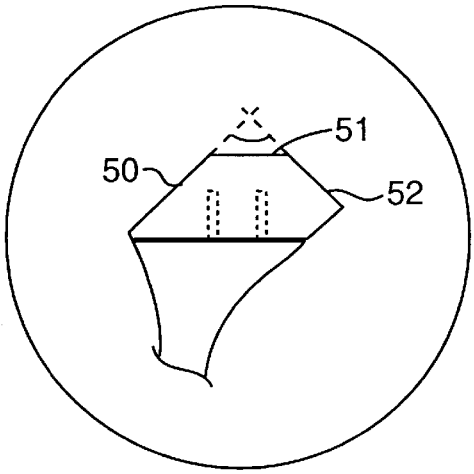
Figure 10:
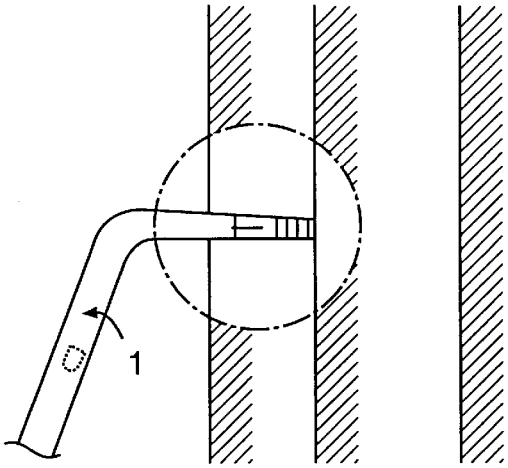
FIGS. 10, 10*a*, 10*b* and 10*c* show similarly to FIG. 9 pairwise-arranged one-piece supporting paws but in circular-disc form.
Figure 10A:
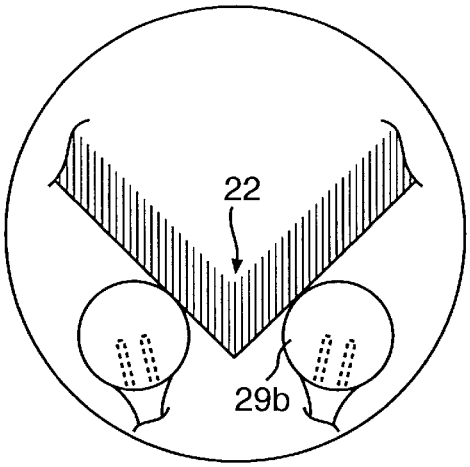
Figure 10B:
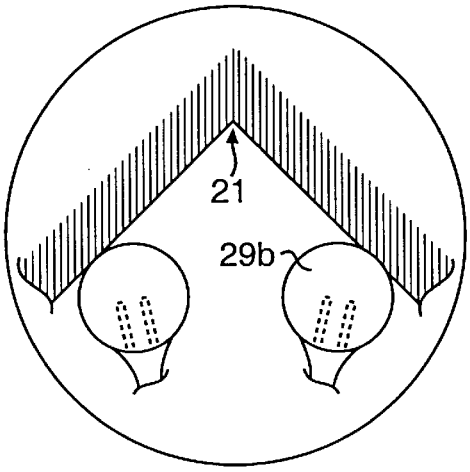
Figure 10C:
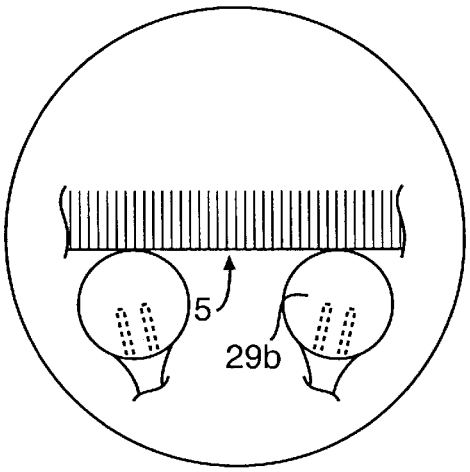

FIGS. 8 and 8*a* show the use of the positioning supports 20 in the case of a ladder 1 with an arrangement fastening by means of the pivot pins 30, 30' respectively. FIG. 8 shows that various ladder widths LB can be connected with the pivot pins 30, 30', since the corresponding dimensions Spi and Spa respectively of the pivot pins 30, 30' are designed in accordance with the largest and smallest ladder widths.

FIGS. 9, 9*a*, 9*b* and 9*c* show a simplified form of the supporting paws 29*a*, the supporting paw 29*a* being formed here of a single body made of rubber or synthetic plastic material. The supporting paw 29*a* has an inside, front, and outside bearing contact surface 50, 51, 52 respectively, the inside bearing contact surface 50 forming an angle ζ of about 90° relatively to the outside bearing contact surface 52.

In FIGS. 10, 10*a*, 10*b* and 10*c* a disc-shaped supporting paw 29*b* has been used.

Figure 11:
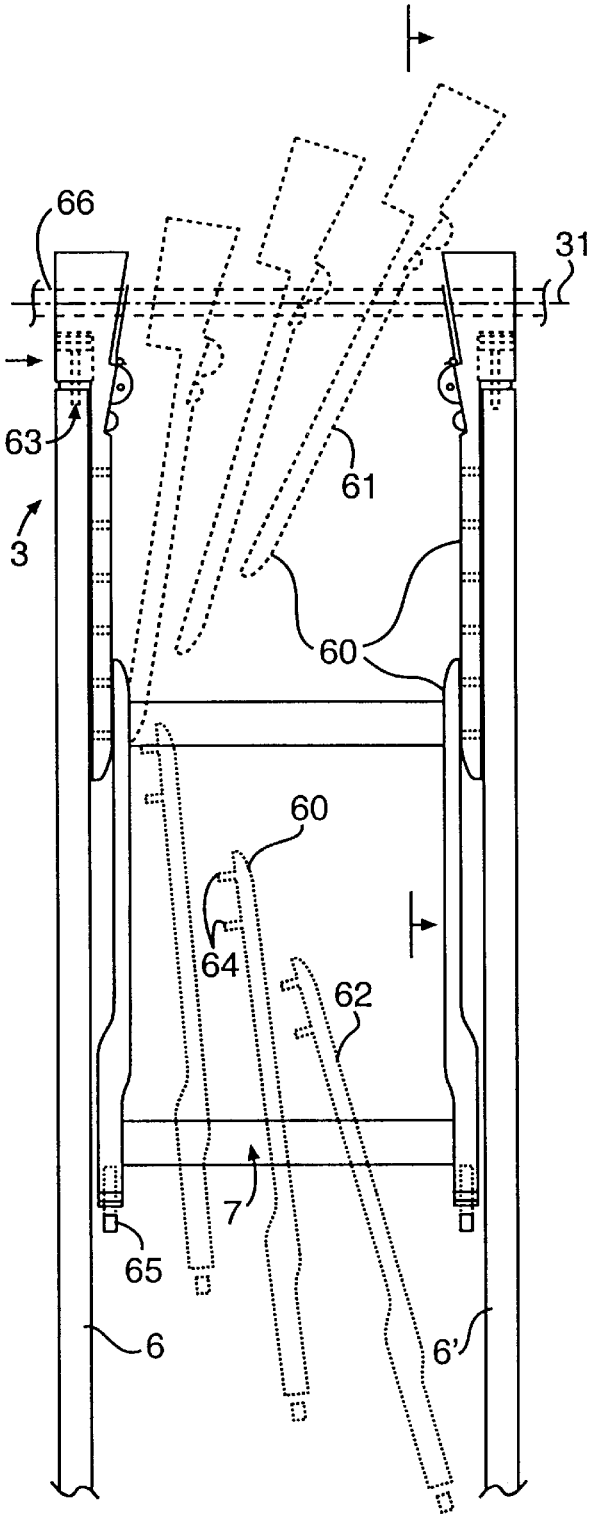
FIGS. 11, 11*a*, 11*b*, 11*c* and 11*d* show various elements of a modular system, especially with a transition piece.
Figure 11A:
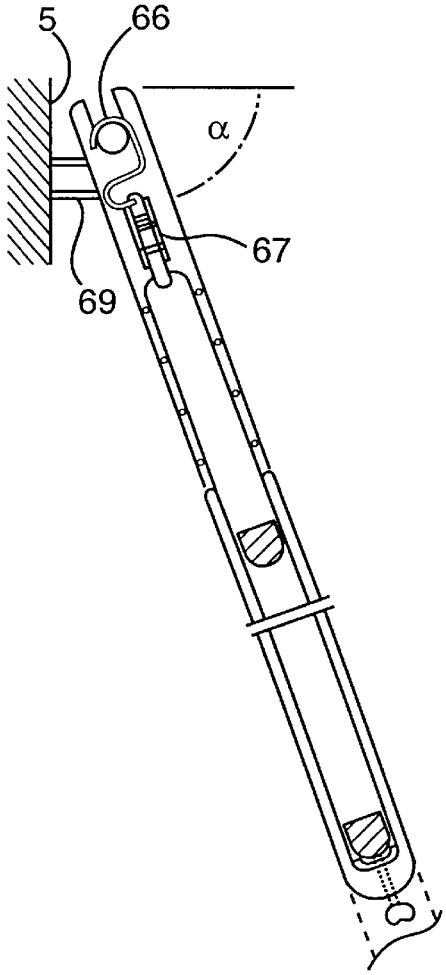
Figure 11B:
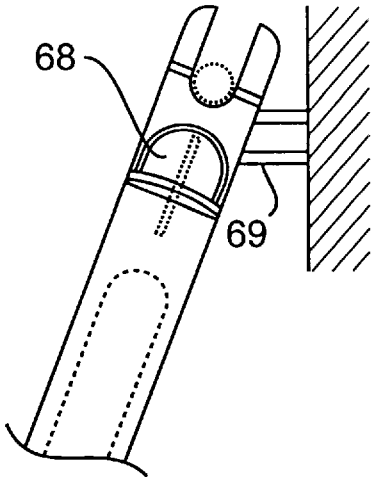
Figure 11C:
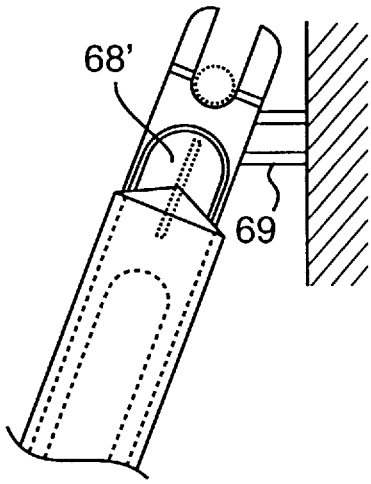
Figure 11D:
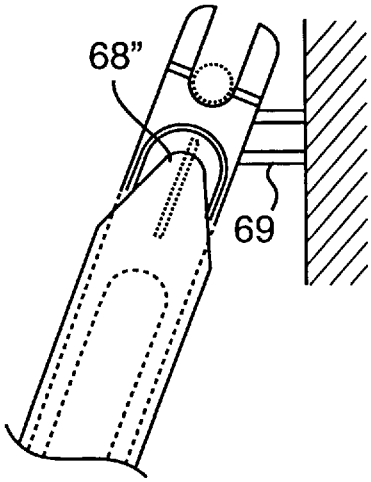

FIGS. 11 and 11*a* show the upper application end 3 of a ladder 1. On each of the two stiles 6, 6' a transition piece 60 is mounted, at the head top and along the inside of the stiles 6, 6'. Each transition piece 60 consists of a joint head upper part 61 and a clamping part 62. The joint head upper part 61 is given a shape adapted to the head top, and can be secured by means of a cotter pin 63 in the stiles 6, 6' respectively. The clamping part is connected by means of dogs 64 to the joint head upper part 61, and is clamped by means of a clamping nut 65 to the joint head upper part 61 against a rung 7. The joint head upper part 61 has at the end an articulation 66 which is constructed for securing for example the pivot pins 30, 30', in accordance with FIGS. 2 and 3. Each pivot pin 30, 30' (axis of rotation 31) is secured against the transition piece 60 by means of a rapid-action clamping element 67. FIGS. 11*b*, 11*c* and 11*d* have three different forms of transition section pieces 68, 68', 68" respectively so that the transition piece can also be adapted to various stile forms and/or types. A rubber abutment 69 is also securely mounted on the transition piece 60. The rubber abutment 69 has a double function: firstly it constitutes a non-damaging bearing contact support on a flat wall 5, and secondly the rubber abutment 69 serves as an abutment for the positioning support 20 also (FIGS. 2, 2*a*, 2*b*, 2*c*).

FIGS. 12, 12*a*, 12*b* and 12*c* show the use of protective caps 70 which can be mounted on each stile 6, 6' for example in place of the positioning supports 20, with the same kind of securing arrangement, by means of rapid-action clamping elements 67. The protective caps allow the application of the ladder against highly vulnerable surfaces such as to avoid damage and protect the transition pieces 60 from fouling.

Figure 13:
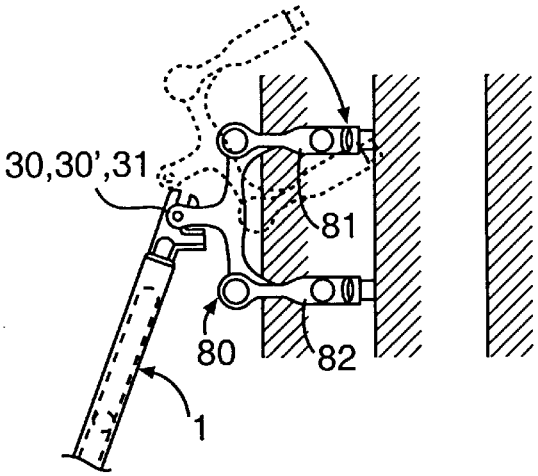
FIGS. 13, 13*a*, 13*b*, 13*c*, 13*d* and 13*e* show a positioning support with four supporting arms for surface support.
Figure 13A:
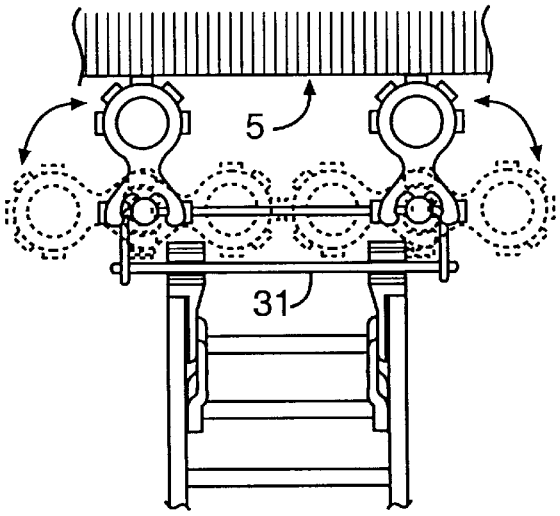
Figure 13B:
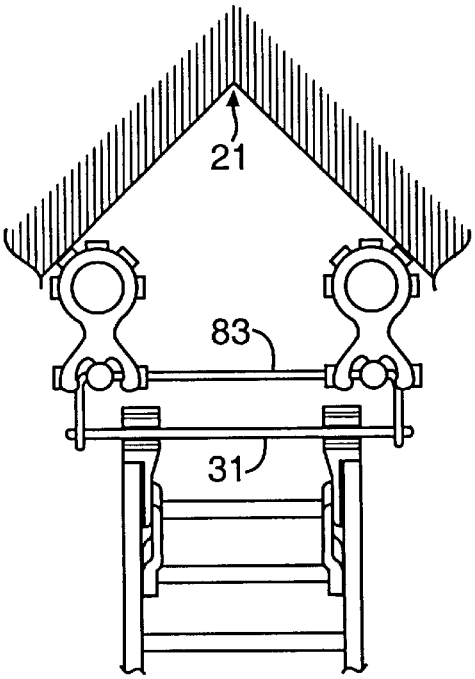
Figure 13C:
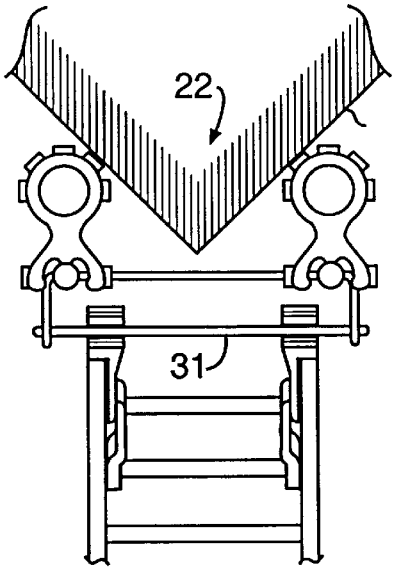
Figure 13D:
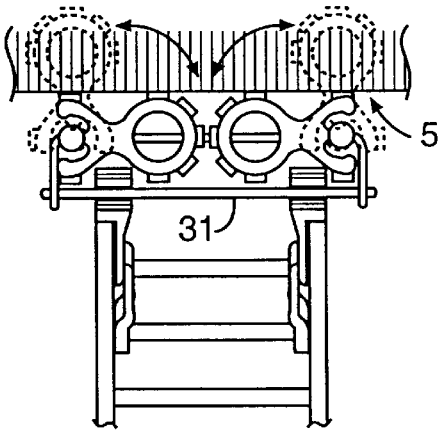
Figure 13E:
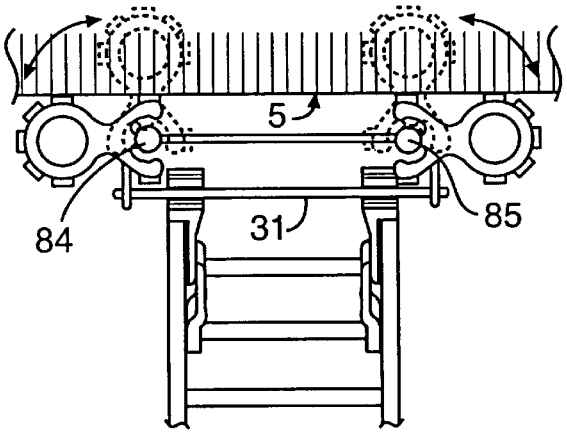

FIGS. 13, 13*a* to 13*e* show a face support 80 which in an analogous manner to FIGS. 2, 2*a* to 2*c*, is securable by means of an axis of rotation 31 or pivot pin 30,30' to the transition piece of a ladder 1. The face support 80 shows the double use of the supporting arms which here are arranged as a pair in each case offset vertically. The upper support part 81 and lower support part 82 are adjustable by means of in each case a spacing-pattern pivot 84/85 and secured on the connecting rod 83. FIG. 13*a* shows the use of the face support on a flat wall 5, FIG. 13*b* on an internal corner, and FIG. 13*c* on an external corner. The two support parts 81 and 82 according to a further feature are adapted to move pivotally about a vertical pivot point 84, 85 respectively outwardly and inwardly. FIG. 13*d* shows the support parts 81 and 82 in the pivoted-in position on a straight wall 5. FIG. 13*e* shows the swung-out position wherein the supporting surface is almost doubled as compared to FIG. 13*d*. The solutions of FIGS. 13*d* and 13*e* are suitable especially for leaning the ladder directly against glass or other highly vulnerable surfaces.

I claim:

1. A positioning support for attaching to two stiles of a ladder, the support for engaging vertical wall structures with internal corners, external corners, and flat surfaces, the support comprising:

a ladder head assembly having a plane of symmetry and two supporting arms disposed on opposing sides of said plane, each supporting arm having a distal free end spaced from the plane, each distal end having a first, middle planar surface disposed in a plane generally perpendicular relative to the plane of symmetry for mounting an element for engaging a flat wall surface, a second, inwardly-directed planar surface contiguous to the first surface and disposed in a plane at a first angle different from 0° and from 90° relative to the plane of symmetry for mounting an element for engaging a wall surface adjacent an external corner, and a third, outwardly-directed planar surface contiguous to the first surface opposite the second inwardly-directed planar surface and disposed in a plane at a second angle relative to the plane of symmetry different from 0° and from 90° and from said first angle, for mounting an element for engaging a wall surface adjacent an internal corner, the second and third surfaces extending in opposite directions from opposite ends of the middle surface at substantially a same angle with respect to the middle surface; and elastic wall engaging elements mounted on the first, second, and third surfaces of the supporting arms.

2. The positioning support of claim 1 further including transition pieces for removably attaching the ladder head assembly to the stiles in a rotatable manner.

3. The positioning support of claim 1 wherein said head assembly supporting arms are separate components having respective proximal ends and wherein the two proximal ends of the supporting arms are fixedly joined to one another along said plane of symmetry.

4. The positioning support of claim 1 wherein the elastic wall engaging elements are rubber studs each having a circular cross-section and a recessed central engaging portion.

5. The positioning support of claim 1 further including each arm having a fourth, inwardly-directed surface for mounting an element for engaging an upright post-type structure, said fourth surface disposed in a plane at a third angle relative to the plane of symmetry and disposed between the respective second inner surface and the plane of symmetry; and respective elastic engaging elements mounted on the fourth surfaces.

6. The positioning support as in claim 1 wherein each of said second and third surfaces also is angled about 45° with respect to a respective one of said first surfaces.

7. A kit for modifying a ladder having a pair of stiles, the kit comprising the positioning support of claim 2.

8. A ladder comprising:

two stiles connected by a plurality of rungs, each stile having a top end;

a ladder head assembly having a plane of symmetry and two supporting arms, disposed on opposing sides of said plane each supporting arm having a distal free end spaced from the plane, each distal end having a first, middle planar surface disposed in a plane generally perpendicular relative to the plane of symmetry for mounting an element for engaging a flat wall surface, a second, inwardly-directed planar surface contiguous to the first surface and disposed in a plane at a first angle different from 0° and from 90° to the plane of symmetry for mounting an element for engaging a wall surface adjacent an external corner, and a third, outwardly-directed planar surface contiguous to the first surface opposite the second inner surface and disposed in a plane at a second angle to the plane of symmetry different from 0° and from 90° and from said first angle, for mounting an element for engaging a wall surface adjacent an internal corner, the second and third surfaces extending in opposite directions from opposite ends of the middle surface at substantially a same angle with respect to the middle surface;

a transition piece mounted on the top end of each stile attaching the ladder head assembly to the respective stile; and elastic wall engaging elements mounted on the first, second, and third surfaces of the supporting arms, wherein the positioning support extends outwardly from a plane formed by the two stiles of the ladder.

9. The ladder as in claim 8 wherein each of said second and third surfaces also is angled about 45° with respect to a respective one of said first surfaces.

* * * * *